US005980288A

United States Patent [19]

Jarvis

[11] Patent Number: 5,980,288

[45] Date of Patent: Nov. 9, 1999

[54] FLAME PROOF ELECTRICAL CONNECTOR

[76] Inventor: George Graham Jarvis, 47 Maria Street, Fontainbleau, Randburg, South Africa

[21] Appl. No.: 08/853,451

[22] Filed: May 9, 1997

[30] Foreign Application Priority Data

May 12, 1996 [ZA] South Africa ..... 96/2703
May 13, 1996 [ZA] South Africa ..... 96/3770

[51] Int. Cl.[6] ..... H01R 29/00

[52] U.S. Cl. ..... 439/188; 439/700

[58] Field of Search ..... 439/188, 187, 439/824, 700

[56] References Cited

U.S. PATENT DOCUMENTS

| | | | |
|---|---|---|---|
| 3,083,274 | 3/1963 | Sparkes | 439/188 |
| 3,646,498 | 2/1972 | Reed | 439/188 |
| 4,703,986 | 11/1987 | McCormick | 439/188 |
| 5,626,485 | 5/1997 | Clyatt, III et al. | 439/188 |

FOREIGN PATENT DOCUMENTS

| | | | |
|---|---|---|---|
| 4-334908 | 11/1992 | Japan | 439/188 |
| 817355 | 10/1981 | South Africa . | |
| 817356 | 10/1981 | South Africa . | |
| 637969 | 5/1950 | United Kingdom . | |
| 662459 | 12/1951 | United Kingdom . | |
| 676034 | 7/1952 | United Kingdom . | |
| 933344 | 8/1963 | United Kingdom . | |
| 961482 | 6/1964 | United Kingdom . | |
| 968483 | 9/1964 | United Kingdom . | |
| 1054872 | 1/1967 | United Kingdom . | |
| 1 228 567 | 4/1971 | United Kingdom . | |
| 1 255 024 | 11/1971 | United Kingdom . | |
| 1 433 931 | 4/1976 | United Kingdom . | |
| 2 091 405 | 2/1985 | United Kingdom . | |

*Primary Examiner*—Hien Vu
*Attorney, Agent, or Firm*—Jones, Tullar & Cooper, P.C.

[57] ABSTRACT

A flame proof electrical connector which includes a first housing, a connector block which, together with at least a section of the first housing, defines a flame proof volume, first and second sets of terminals at least partly inside the volume which are electrically connected to one another when the connector block is at a first position and which are electrically disconnected from one another when the connector block is moved away from the first position, and means for biasing the connector block away from the first position.

10 Claims, 7 Drawing Sheets

24
74
76
78
80
72
65
66
68
70
68
66
23
48
40
20
62
64
44
58
52
54
50
56
16
36
46
38
18

FLAME PROOF ELECTRICAL CONNECTOR

BACKGROUND OF THE INVENTION

This invention relates to a flame proof electrical connector.

SUMMARY OF THE INVENTION

The invention provides a flame proof electrical connector which includes a first housing, a connector block which, together with at least a section of the first housing, defines a flame proof volume, first and second sets of terminals at least partly Inside the volume which are electrically connected to one another when the connector block is at a first position and which are electrically disconnected from one another when the connector block is moved away from the first position, and means for biasing the connector block away from the first position.

The said section of the first housing may comprise a tubular section, which may be substantially circular cylindrical, and the conductor block may be located Inside the tubular section. The connector block may be movable substantially linearly within the tubular section. This may be achieved in any suitable way and, for example, opposing surfaces of the connector block and the tubular section may include key ways which permit relative linear movement between these components and which inhibit relative rotational movement of the components.

Means may be provided for limiting the extent of movement of the connector block away from the first position. This may be achieved in any appropriate way and, In one example Of the Invention, use is made of a circlip or similar device which limits the relative movement of the connector block.

The first mat of terminals may be mounted to the housing and the second set of terminals, which preferably are in the form of a set of electrically conductive rings, may be mounted to the connector blocks The electrical connector may include a third set of terminals which are mounted to a connecting member and which are respectively electrically connectable to the second set of terminals.

Collar means may be provided for securing the connecting member to the first housing.

The electrical connector may include a second housing with electrical component heat sinking capabilities. The heat sink characteristic may be provided in any appropriate manner and preferably the second housing Includes cooling fins and is made from a metal or alloy which, apart from its heat sink capability, has the additional advantage that it does not readily generate a spark, or ignite under extreme temperature conditions. The second housing may be Integrally formed, eg from an extrusion, or be post formed, eg from components which are fixed together. For example a heat sink member may be bonded or applied, directly or indirectly, to a suitable casing.

Electrical components may be located inside the second housing. These components may be electrically connected to the third set of terminals and to an electrical device of any desired kind such as a fluorescent tube.

The fluorescent tube may be positioned inside a translucent tubular housing which extends from the second housing.

Preferably Indicator means are positioned Inside the tubular housing for indicating the status of one or more of the following; the fluorescent tube; the electrical components; the electrical connections between the respective sets of terminals; an electrical power source connected to the first set of terminals.

The first housing may include first and second connection formations respectively for first and second electrical conductors, such as cables, and the formations may be oriented so that the electrical conductors, when connected to the formations, have respective portions adjacent the formations which are in-line with each other and with the tubular housing.

This in-line connection capability which ensures that cables leading to and from the electrical connector of the invention are in line with each other, at least in a region which Is adjacent the electrical connector, considerably facilitates the installation of a plurality of the electrical connectors particularly when these connectors themselves are to be installed in-line.

According to a different aspect of the invention there is provided a flame proof electrical connector which includes a housing assembly and a translucent tubular housing which extends from the housing assembly and which, in use, houses a fluorescent tube, at least a section of the housing assembly having a heat sink characteristic.

According to a variation of the invention there is provided a flame proof electrical connector which Includes a housing assembly and a translucent tubular housing which extends from the housing assembly and which, in use, houses a fluorescent tube, and Indicator means, inside the tubular housing, for indicating the status of at least one Of the following: the fluorescent tube; electrical components inside the housing assembly; an electrical power source connected to the housing assembly.

In another form of the Invention the flame proof electrical connector includes a housing assembly and a translucent tubular housing which extends from the housing assembly and which, in use, houses a fluorescent tube, the housing assembly further including first and second connection formations respectively for first and second electrical conductors such as cables, the formations being oriented so that electrical conductors, when connected to the formations, have respective portions adjacent the formations which are in-line with each other and with the tubular housing.

BRIEF DESCRIPTION OF THE DRAWINGS

The Invention is further described by way of examples with reference to the accompanying drawings in which.

DESCRIPTION OF PREFERRED EMBODIMENTS

Figure 1:
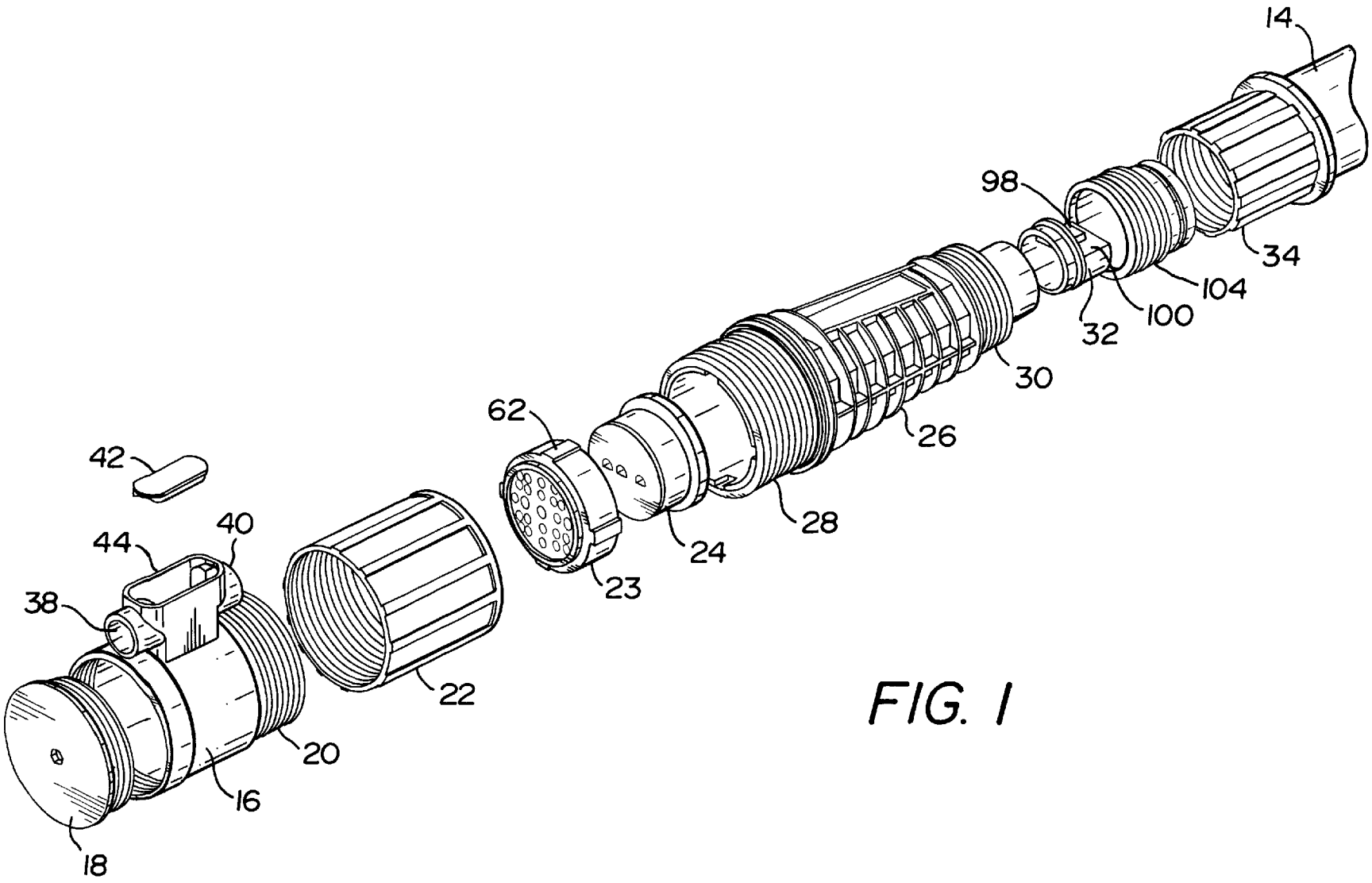
FIG. 1 is an exploded view, in perspective, of portion of a flame proof electrical connector according to the invention.
Figure 2:
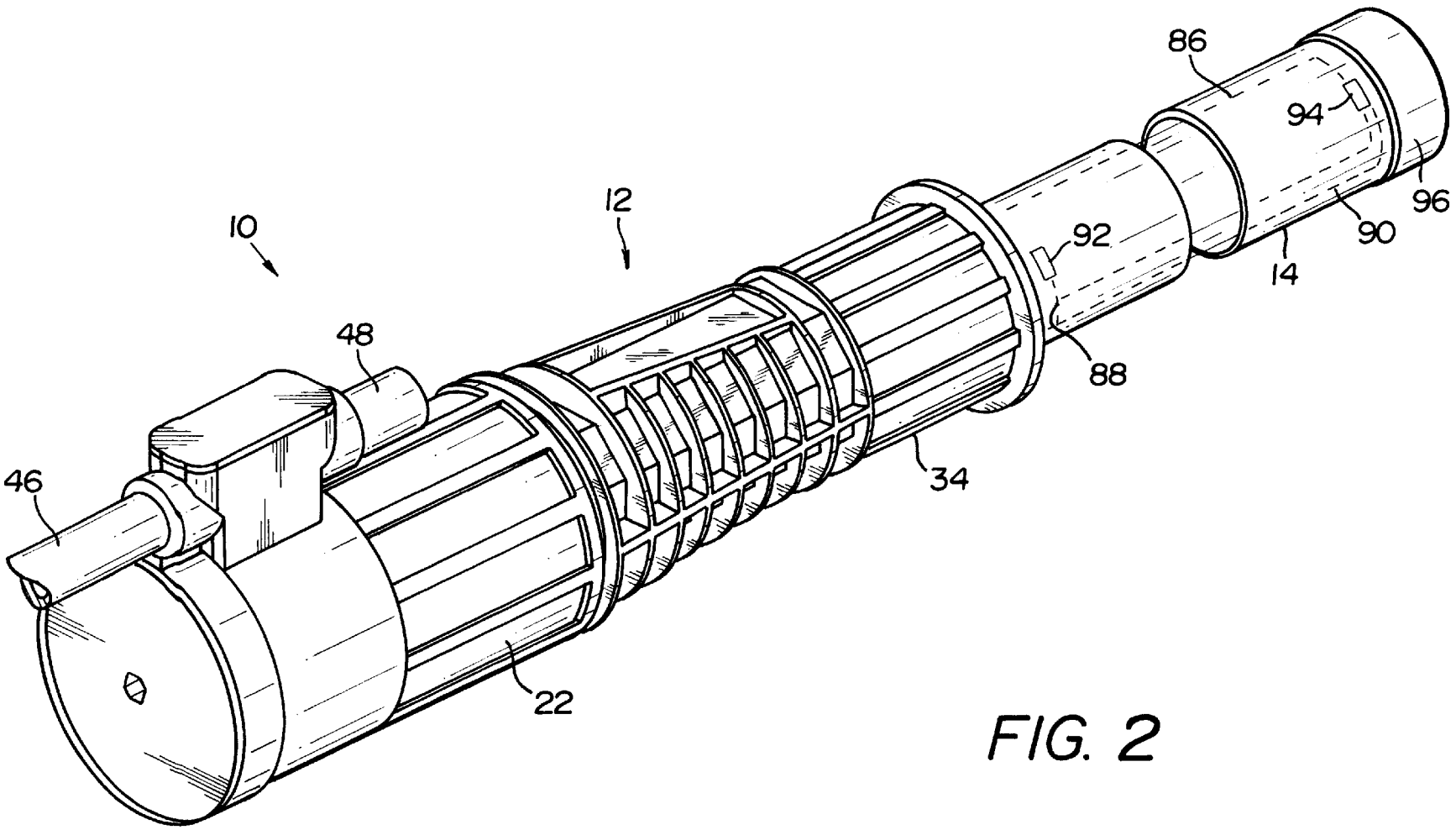
FIG. 2 illustrates the components shown in FIG. 1 , connected to one another to form a housing assembly, and with a translucent tubular housing extending from the housing assembly.
Figure 3:
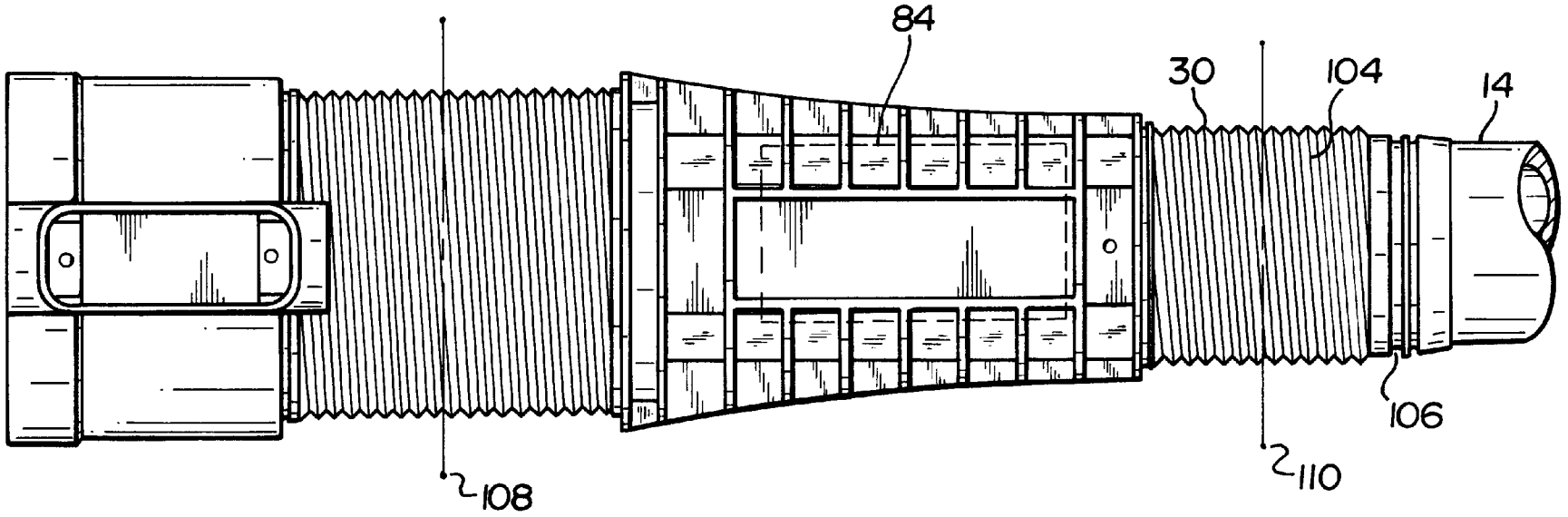
FIG. 3 is plan view of the arrangement shown in FIG. 2 but with connecting collars removed.

Referring initially to FIG. 1, 2 and 3 a flame proof electrical connector 10 includes a housing assembly 12 from which extends a translucent tubular holder 14, for example of polycarbonate.

Figure 4:
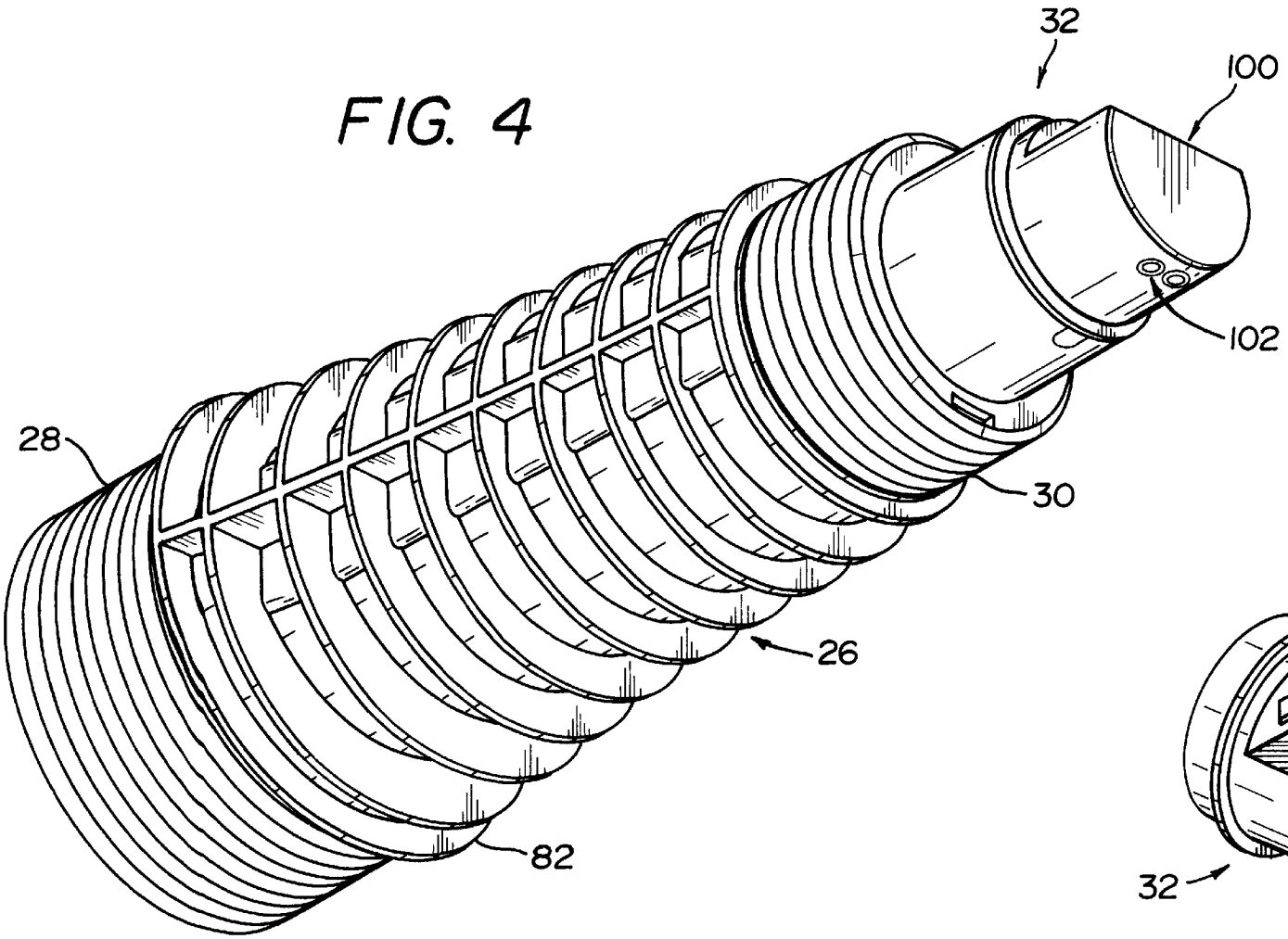
FIG. 4 is an underview, in perspective, of a housing which contains electrical components and which has a heat sink capability.

The housing assembly includes a first housing 16 which has a screw end cap 18 and a threaded spigot 20, a first internally threaded collar 22, a connector block 23, a connecting member 24, a second housing 26, which in shown from the underside in FIG. 4 and which has opposed threaded end portions 28 and 30 respectively, an end plug 32, and a second collar 34 which is also internally threaded.

Figure 6:
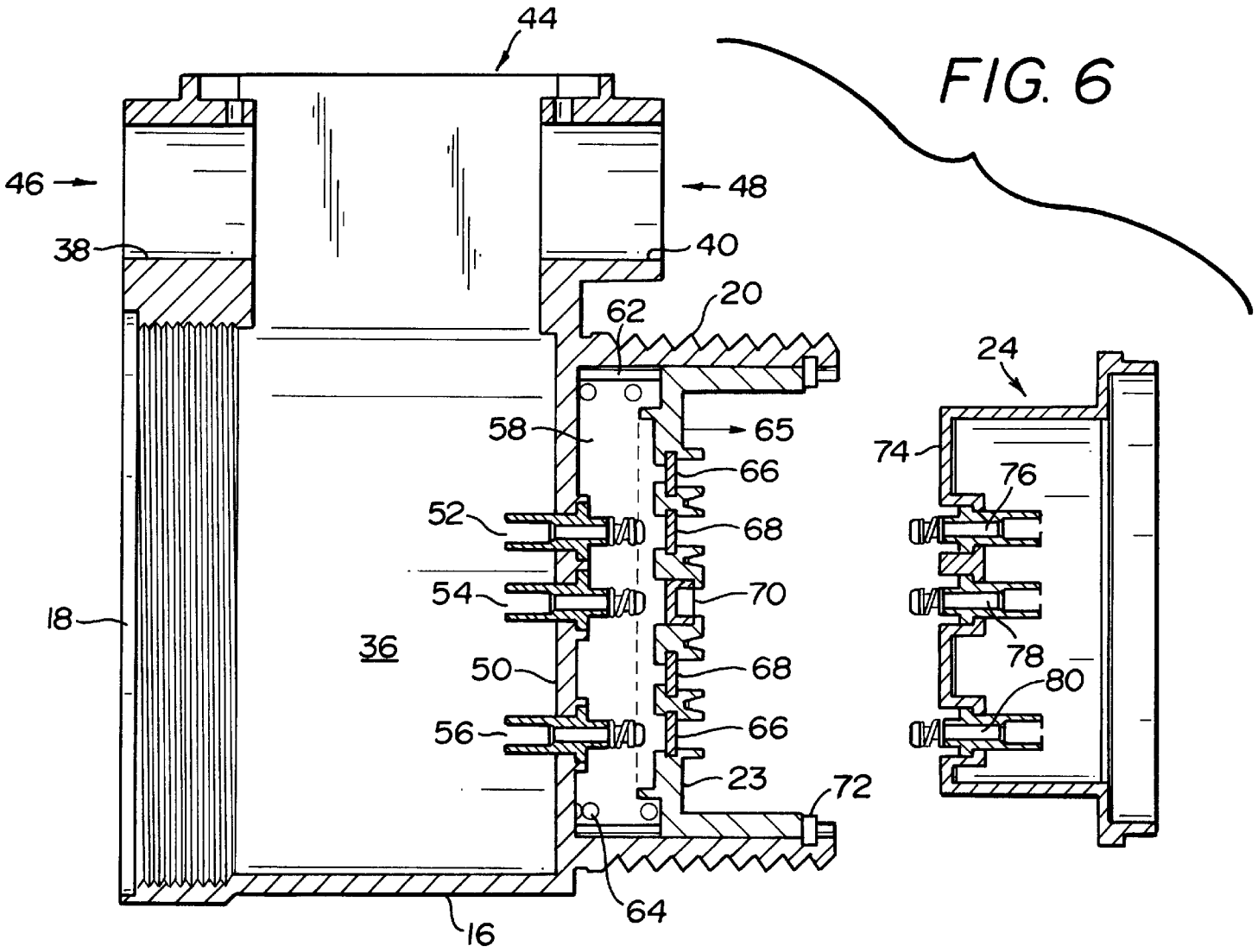
FIG. 6 is a cross sectional side view, an an enlarged scale, of an end portion of the electrical connector shown in FIGS. 1, 2 and 3.

The first housing 16 is shown from the side and in cross section, on an enlarged scale, in FIG. 6. The screw end cap 18, when engaged with the first housing, defines an enclosed volume 36. In-line threaded sockets 38 and 40 are positioned on an upper end of the first housing. A cap 42 is engagable with a mouth 44 between the formations 38 and 40, to seal the volume 36. The cap 42 is bonded in place, to provide a permanent seal, after the relevant electrical connections have been made.

The cap 18 may be removed, as required, to provide access to the volume 36.

The formations 38 and 40 in use receive cable glands or similar connectors which enable in-line connections to be made to cables 46 and 48 respectively, shown in FIG. 2. These connections are also in line with the holder 14.

A wall 50 of the first housing has a first set of electrical terminals 52, 54 and 56 respectively, mounted to it. These terminals comprise spring-loaded terminal posts and are connected to live, earth and neutral conductors, not shown, extending to the cables 46 and 48. These electrical connections are made inside the chamber 36, and are in parallel to the conductors in the cables 46 and 48.

The terminal posts protrude to the right hand side of the wall 50, see FIG. 6.

The threaded spigot 20 and the wall 50, define a flame proof volume 58 which is bounded, on the right hand side, by the connector block 23, which is cup-shaped.

The connector block 23 and the inner surface of the threaded spigot 20 have key-way formations 62 which permit limited linear sliding movement of the connector block inside the spigot but which prevent rotational movement of the connector block relatively to the spigot. A helical spring 64 acting between the wall 50 and the connector block exam a biasing force which urges the connector block away from the terminals 62 to 56, in the direction of an arrow 65.

The surface of the connector block which opposes the wall 50 has a second set of electrical terminals in the form of two outer slip rings 66 and 68, and an inner slip ring 70. The slip rings present conducting surfaces on both sides of the connector block.

A circlip 72, engaged with a groove on an inner surface of the spigot 20, maintains the connector block captive inside he spigot and, when the components are disassembled as shown in FIG. 6, it is apparent that the spring 64 urges the connector block into physical engagement with the circlip and keeps the terminals 52, 54 and 56 out of electrical contact with the terminals 68, 70 and 66 respectively.

FIG. 6 also illustrates the connecting member 24 in cross section. This connecting member is cup-shaped and is of the size which enables it to fit inside the recess of the connector block 23.

The surface 74 of the connecting member 24 which opposes the connector block has a third set of electrical terminals in the form of spring loaded terminal posts 76, 78 and 80 respectively. If the connecting member is moved in to the recess of the cup-shaped connector block 23 then the posts can respectively be brought into contact with the slip rings 68, 70 and 66.

The second housing 26 is, in this example of the invention, made from a metal such as zinc which has a low propensity to spark. Cooling fins 82 are formed over the entire surface between the threaded end portions 28 and 30.

As is shown by means of a doted line in FIG. 3 the second housing 26 contains electrical components 84 which are of a conventional kind and which are not further described herein. The nature of the electrical components is determined by the application of th electrical connector of the invention. In this example of the invention the electrical connector is intended to provide a flame proof connection capability to a fluorescent tube 86, shown in dotted outline only in FIG. 2, which is mounted inside the translucent tubular holder 14. For example the electrical components may comprise starters and ballasts of a kind which are known in the art. Electrical leads 88 and 90, see FIG. 2, extend from the electrical components 84 to opposed ends of the tubular holder 14 and are connected to electrical terminals 92 and 94 respectively, again of a type which is known in the art, and which are engaged with electrical pins, not shown, on opposed ends of the fluorescent tube 86.

It should be noted that the right hand end of the tubular holder 14, see FIG. 2, is sealed by means of a cap 96.

Figure 5:
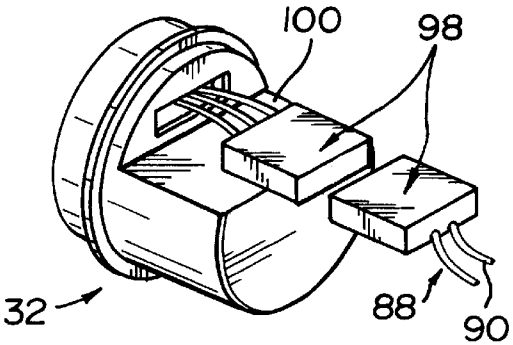
FIG. 5 shows the right hand end of the housing of FIG. 4, from above.

The electrical leads 88 and 90 extend from a releasable plug and socket connector 98, which is shown in FIG. 5, and which is positioned on a flat surface 100 on the end plug 32. The connector 98 is particularly advantageous for it enables the fluorescent tube to be easily detached, when required, for service or mechanical repair. The plug 32 protrudes from the threaded end portion 30 of the second housing 26.

System indicators 102, which are light emitting such as, for example, light emitting diodes, are mounted in a surface of the end plug which is remote from the flat surface 100. These system indicators end inside the translucent tubular holder and are visible through the wall of the tubular holder.

The system indicators are used to provide a visual indication of the status of any desired aspect of the electrical connector of the invention. For example the system indicators can be used to provide an indication of the status of the electrical components 84, the status of the electrical connectors between the various sets of terminals shown in FIG. 5 and FIG. 6, the status of the power supply to the terminals, and the status of the fluorescent tube. In each case the status may be monitored using techniques which are known in the art and which consequently are not further described herein. It is pointed out though that an important benefit of the present invention is the provision of the status indicators inside the translucent tubular holder which provide, in a safe manner, a visible indication of a desired status.

The various components are assembled as shown in FIG. 2 with the first collar 22 being threadedly engaged with the spigot 20 and the threaded end portion 28 respectively, and with the second collar 34 being threadedly engaged with the end portion 30 of the second housing.

The second collar 34 is also engaged with a coupling member 104 which is shown in FIGS. 1 and 3. The coupling member is externally threaded and has a hollow interior. The translucent tubular holder 14 is mounted in a sealed manner to the interior of the coupling member. Thus, when the second collar 34 is loosened, it can move with a sliding action, while it is rotating, along the outer surface of the tubular holder and, in a sense, is hold captive thereby. When the second collar 34 is threadedly engaged with the coupling member 104 and the end portion 30 it can be locked in position by means of a circlip, not shown, which is engaged with a groove 106 in a shoulder of the collar.

It is pointed out that, in FIG. 3, lines 108 and 110 are used to designate interfaces between the spigot 20 and the end portion 28 on the one hand, and the end portion 30 and the coupling member 104 on the other hand.

The electrical connector 10 is used to provide a flame proof electrical connection to the fluorescent tube K which is held inside the sealed translucent tubular holder 14. Electrical connections are made to opposed ends of the tube by means of the terminals 92 and 94. The electrical components 84 inside the housing 26, in use generate heat and this heat is dissipated in an effective manner by means of the metallic body of the housing and the cooling fins 82. The connection arrangement shown in FIG. 6 is provided inside a sealed environment. It has already been pointed out that cable connections to the housing 16 are made so that they are in-line with each other and with the fluorescent tube and that this is particularly beneficial when a large number of fluorescent tubes are to be connected, electrically in parallel with each other, but physically in an in-line relationship. The path which is followed by the interconnecting cables is consequently substantially in line.

If the system indicators indicate that a fluorescent tube is faulty then it would be necessary to replace the tube. In a fiery environment this must be done without generating an electrical spark. The arrangement shown in FIG. 6 is designed to enable electrical connections to be made or broken in a safe manner.

It the collar 22 is to be disengaged from the spigot 20 then it is necessary to rotate all of the components of the connector from the tubular holder 14 to the collar 22, relatively to the housing 16. If the two sets of components are rotated electrical connections are maintained between the terminals 76 to 80 and the terminals 68, 70 and 66 respectively. The relative rotation is permitted by virtue of the fact that the terminals 76 to 80 are posts which bear on the corresponding slip rings in the second set of terminals. The connector block 23 is constrained, as has been pointed out, against rotating inside the spigot 20.

As the connecting member 24 is rotated it moves away from the connector block and this movement is taken up by the biasing action of the spring 64 which urges the connector block to the right and which maintains the second and third sets of terminals in contact with each other. Ultimately the connector block is moved to a position at which the electrical contacts between the first and second sea of terminals are broken, as shown in FIG. 6. The breaking of this electrical contact is achieved inside the flame proof volume 68 and any sparks which may occur are therefore not exposed to the external atmosphere. The dimensions of the connector arrangement shown in FIG. 6 are such that it is only after the electrical connections between the first and second sets of terminals are broken that the electrical connections between the second and third sets of terminals are broken. At this stage however the second set of terminals is not live and consequently no sparks can be generated by the breaking of the electrical connections between these two sets of terminals.

Once the necessary work has been carried out to restore the functioning capability of the fluorescent tube or any other part thereof which may have been defective, the various components are reconnected to one another in the reverse manner. Thus, initially, electrical connections are achieved between the second and third sets of terminals and, thereafter, as the relative rotation takes place between the first housing 16 and the remainder of the components the connector block 23 is gradually moved linearly, and without rotation, towards the terminals 52 to 56 until such time as electrical connections are made between the respective sets of terminals. Again, if any sparking occurs, this is within the flame proof volume 58.

Figure 7:
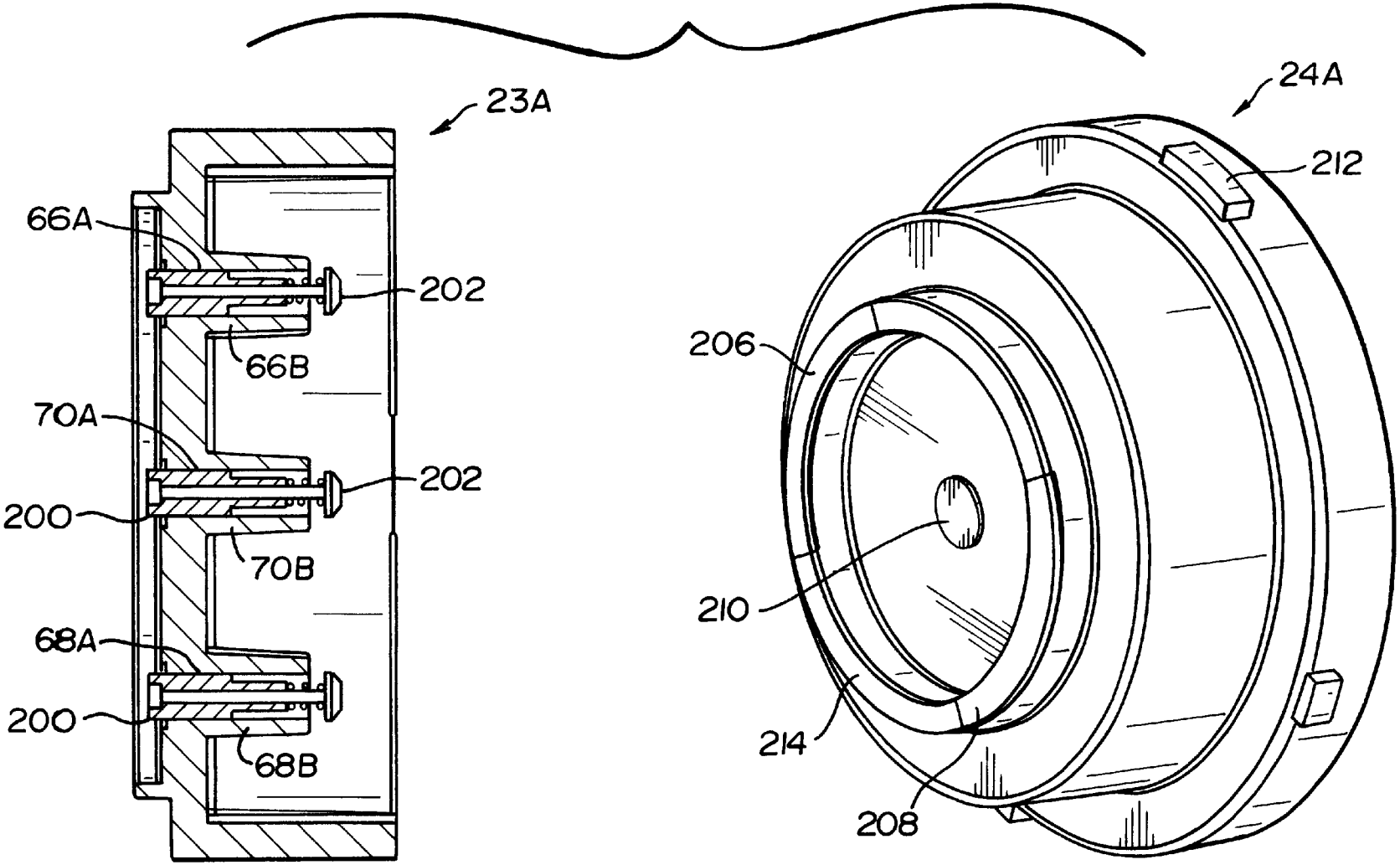
FIG. 7 shows in cross section and perspective, respectively, alternative connector members for in the arrangement of FIG. 1 and FIG. 6.

FIG. 7 illustrates a connector block 23A and a connecting member 24A which can be used in place of the corresponding parts 23 and 24 shown in FIGS. 1 and 6.

The connector block 23A is cup-shaped and, as with the block 23, has key formations which permit linear sliding movement of the connector block inside the spigot 20, but which prevent rotational movement of the connector block relatively to the spigot. The slip rings 66, 68 and 70, in the block 23, are done away with and are replaced by terminal posts 66A, 68A and 70A respectively. These posts are mounted in respective pillars 66B, 68B and 70B. Each post includes a base section 200 and a pin 202 which is biased outwardly by means of a spring 204.

The connecting member 24A has a shape which is similar to that of the member 24 but the terminal posts 76, 78 and 80, in the member 24, are replaced by two outer conductive slip rings 206 and 208 respectively and a central connector plate 210. The connecting member has key formations 212 on an outer peripheral surface. Curved insulating sections 214 are positioned between the slip rings.

As stated, the components 23A and 24A can be used in place of the corresponding components 23 and 24 shown, for example, in FIG. 6. The member 24A is secured to the second housing 26 and electrical connections extend from the slip rings 206 and 208 which serve as live and neutral terminals respectively and from the connector plate 210, which acts as an earth point, to the electric components in the second housing.

The terminals 52,54 and 56, in the housing 16, are positioned to be brought into electrical contact with the respective posts 66A, 70A and 68A.

When the housing 26 is threadedly engaged with the collar 22 the connecting member 24A rotates with the housing 26 due to the engagement of the key formations 212 with corresponding slots in the housing 26. The pins 202 of the two outer posts in the connector bear on the slip ring formations and the intermediate insulating sections 214 of the connecting member, while the pin 202 of the post 70A bears on the connector plate 210.

As the housing 26 is threaded home the connector block 23A is urged into the spigot 20 and the terminals 62 to 56 are respectively brought into contact with the respective base sections 200. The threaded interengagement of the housing 26 and the collar 22 is such that when the housing is engaged to the maximum extent with the collar the pins 202 of the posts 66A and 68A are brought into contact with the slip rings 206 and 208 and, as stated, the pin 202 of the post 70A is in contact with the connector plates.

The arrangement of FIG. 7 thus functions in a manner analogous to the interaction of the connector block 23 and the connector member 24. However the connecting member 24A, unlike the member 24, has no protruding terminals which possibly could be damaged when the housing assembly is disassembled.

Figure 8:
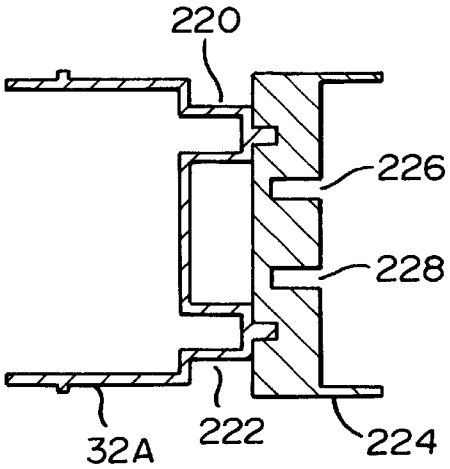
FIGS. 8 and 9 show components for use in a modified fluorescent tube holder which can be used with the flame proof electrical connector.
Figure 9:
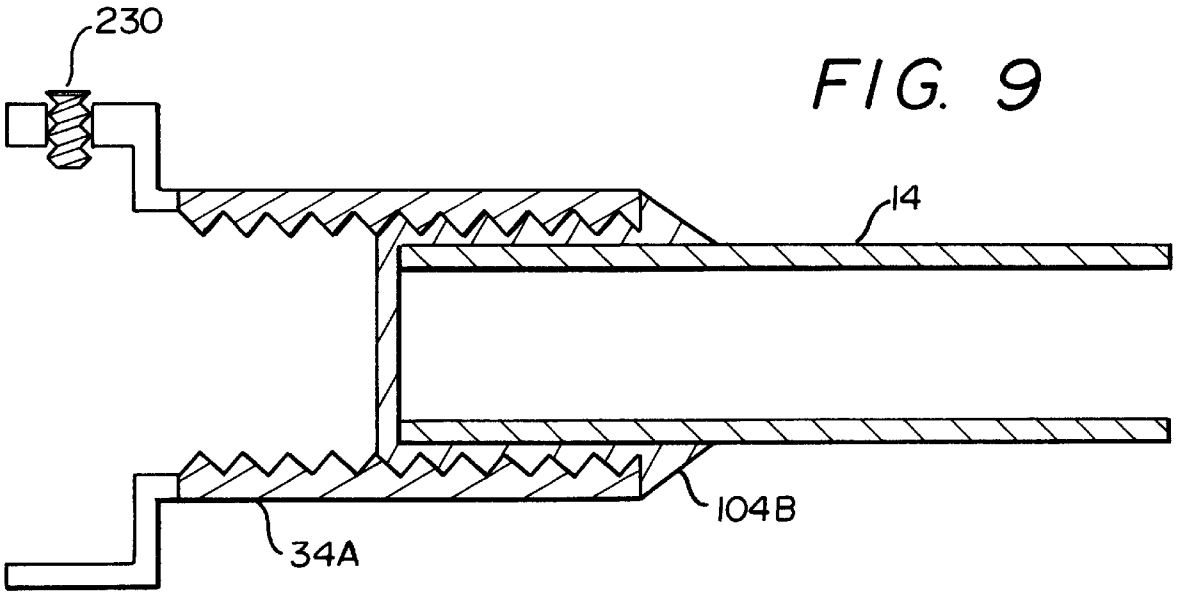

FIGS. 8 and 9 illustrate a modification of the invention which enable the translucent tubular holder 14, which houses the fluorescent tube, to be connected to the remainder of the flame proof connector, in a different manner to what has been described hereinbefore.

FIG. 8 illustrates, in cross section, a modified end plug 32A which has mounting posts 220 and 222 respectively. A fluorescent tube holder 224 is fixed to the posts. This holder has two contacts, 226 and 228 respectively which receive the conventional end pins of a fluorescent tube, not shown, and which make electrical contact therewith. Electrical leads, not shown, extend from the contacts through the end plug 32A to the releasable plug and socket connector 98, which is shown in FIG. 1, but not in FIG. 8.

FIG. 9 illustrates the translucent tubular holder 14 which is adhesively attached to a modified coupling member 104B, which is used in place of the member 104. The member 1040B is threadably engaged with a modified collar 34A, used instead of the collar 34, and, additionally, is adhesively attached to the collar 34A.

The collar 34A carries a grub screw 230.

The assembly shown in FIG. 8 extends from the right hand side of the second housing 26. The fluorescent tube, as has been noted, projects from the tube holder 224 and is positioned inside the holder 14. The collar 34A is threadedly engaged with the end portion 30 of the housing 26 and when it is in position the grub screw 230 is advanced so that if the collar 34A is rotated, in either direction, it will be brought into contact with one of the cooling fins on the housing 26. This prevents reverse rotation of the collar.

With the arrangement of FIGS. 8 and 9 n the fluorescent tube is to be serviced or replaced then the grub screw 230 is released and the components shown in FIG. 9 are threadedly disengaged from the housing 26. The tube holder 224 is thereby exposed and a fresh fluorescent tube can be electrically engaged with the contacts 226 and 228. Thereafter the collar 34A is reengaged with the threaded portion 34.

What is claimed is:

1. A flame proof electric connector comprising:

a first housing, said first housing having a tubular section;

a connector block, said connector block being located for movement at least partly inside said tubular section to define a flame proof volume inside said tubular section;

a first set of terminals mounted to said first housing and a second set of terminals mounted to said connector block and located at least partly inside said flame proof volume, said first set of terminals and said second set of terminals being electrically connected to each other when said connector block is moved within said tubular section to a first position, said first set of terminals and said second set of terminals being electrically disconnected when said connector block is moved away from said first position;

spring means for biasing said connector block away from said first position;

a connecting member engagable with said connector block;

a third set of terminals mounted to said connecting member, said third set of terminals being electrically connectable to said second set of terminals;

a second housing having a heat sink thereon, said second housing engaging with said connecting member and said first housing; and electrical components in said secondhousing, said electrical components being electrically connected to said third set of terminals.

2. An electrical connector according to claim 1 wherein the connector block is constrained to move linearly with the tubular section.

3. An electrical connector according to claim 1 which includes means for limiting the extent of movement of the connector block away from the first position.

4. An electrical connector according to claim 1 which includes collar means for securing the connecting member to the first housing.

5. An electrical connector according to claim 1 which includes a translucent tubular housing which extends from the second housing and connection means, for a fluorescent tube inside the tubular housing, connected to the electrical components.

6. An electrical connector according to claim 5 which includes indicator means, inside the tubular housing, indicating the status of at least one of the following; the fluorescent tube; the electrical components; the electrical connections between the respective sets of terminals.

7. An electrical connector according to claim 5 which includes a releasable connector for making or breaking an electrical connection between the fluorescent tube and the electrical components, which fluorescent tube is completely within the tubular housing.

8. An electrical connector according to claim 1 which includes a translucent tubular housing for a fluorescent tube which is connected directly or indirectly to the connector block.

9. An electrical connector according to claim 1 wherein the first housing has first and second connection formations respectively for first and second electrical conductors, the formations being oriented so that the electrical conductors, when connected thereto, have respective portions adjacent the formations which are in-line with each other and the tubular housing.

10. An electrical connector according to claim 1 wherein the second set of terminals are in the form of a set of electrically conductive rings.

* * * * *